US010036362B2

(12) United States Patent
Skowronek et al.

(10) Patent No.: US 10,036,362 B2
(45) Date of Patent: Jul. 31, 2018

(54) IGNITION SYSTEM AND METHOD FOR CONTROLLING AN IGNITION SYSTEM FOR A SPARK-IGNITED INTERNAL COMBUSTION ENGINE

(71) Applicant: Robert Bosch GmbH, Stuttgart (DE)

(72) Inventors: Tim Skowronek, Missen-Wilhaus (DE); Thomas Pawlak, Immenstadt (DE); Joerg Eichhorn, Buehl (DE); Wolfgang Sinz, Hergatz (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/329,697

(22) PCT Filed: Jun. 8, 2015

(86) PCT No.: PCT/EP2015/062670

§ 371 (c)(1),
(2) Date: Jan. 27, 2017

(87) PCT Pub. No.: WO2016/020087

PCT Pub. Date: Feb. 11, 2016

(65) Prior Publication Data

US 2017/0211537 A1 Jul. 27, 2017

(30) Foreign Application Priority Data

Aug. 5, 2014 (DE) ..... 10 2014 215 369

(51) Int. Cl.
*F02P 3/045* (2006.01)
*F02P 9/00* (2006.01)
*F02P 3/04* (2006.01)

(52) U.S. Cl.
CPC ..... *F02P 3/045* (2013.01); *F02P 3/0407* (2013.01); *F02P 9/007* (2013.01)

(58) Field of Classification Search
CPC .. F02P 3/045; F02P 9/007; F02P 17/12; F02P 3/0407; F02P 3/0876; F02P 3/05; F02P 3/051; F02P 9/002
See application file for complete search history.

(56) References Cited

U.S. PATENT DOCUMENTS

2004/0000878 A1 1/2004 Petruska et al.
2007/0175461 A1* 8/2007 Wada ..... F02P 3/051 123/637

(Continued)

FOREIGN PATENT DOCUMENTS

CN 1378619 A 11/2002
DE 4105399 A1 9/1991

(Continued)

OTHER PUBLICATIONS

International Search Report dated Aug. 25, 2015, of the corresponding International Application PCT/EP2015/062670 filed Jun. 8, 2015.

*Primary Examiner* — Lindsay Low
*Assistant Examiner* — George Jin
(74) *Attorney, Agent, or Firm* — Norton Rose Fulbright US LLP; Gerard Messina

(57) ABSTRACT

An ignition system and a method for controlling an ignition system for a spark-ignited internal combustion engine are described, having a primary voltage generator for generating an ignition spark and a boost converter for maintaining an ignition spark. The method includes sending a signal from an engine control unit to the ignition system, in order to determine a predetermined ignition timing for triggering an ignition spark, sending an additional signal from the engine control unit to the ignition system, in order to determine a predetermined additional ignition timing for triggering an additional ignition spark, and sending a control signal for influencing the operating mode of the boost converter from (Continued)

the engine control unit to the ignition system between the signal and the additional signal.

13 Claims, 3 Drawing Sheets

(56) References Cited

U.S. PATENT DOCUMENTS

| | | | | |
|---|---|---|---|---|
| 2016/0281673 | A1* | 9/2016 | Skowronek | F02P 17/12 |
| 2016/0312757 | A1* | 10/2016 | Skowronek | F02P 9/007 |
| 2016/0348633 | A1* | 12/2016 | Skowronek | F02P 3/0407 |
| 2016/0356259 | A1* | 12/2016 | Skowronek | F02P 3/0442 |

FOREIGN PATENT DOCUMENTS

| | | | |
|---|---|---|---|
| DE | 4331994 | A1 | 3/1995 |
| DE | 10248227 | A1 | 4/2004 |
| DE | 102008038512 | A1 | 2/2010 |
| DE | 102008038513 | A1 | 2/2010 |
| DE | 102009024629 | A1 | 2/2010 |
| DE | 102009048618 | A1 | 6/2010 |
| DE | 102013218227 | A1 | 5/2014 |
| EP | 2290223 | A1 | 3/2011 |
| GB | 717676 | A | 11/1954 |
| WO | 9304279 | A1 | 3/1993 |
| WO | 2009106100 | A1 | 9/2009 |
| WO | 2014041070 | A1 | 3/2014 |

* cited by examiner

IGNITION SYSTEM AND METHOD FOR CONTROLLING AN IGNITION SYSTEM FOR A SPARK-IGNITED INTERNAL COMBUSTION ENGINE

FIELD

The present invention relates to an ignition system for an internal combustion engine. The present invention relates, in particular, to an ignition system for internal combustion engines, in which increased demands exist as a result of (high) supercharging and diluted mixtures which are difficult to ignite ($\lambda >> 1$, lean layer concepts, high EGR rates).

BACKGROUND INFORMATION

Great Britain Patent No. GB717676 describes a step-up transformer for an ignition system, in which a circuit element controlled by a vibration switch in the manner of a boost converter is used to supply a spark, generated via the step-up transformer, with electrical power.

PCT Application No. WO 2009/106100 A1 describes a circuit configuration designed corresponding to a high-voltage capacitor ignition system, in which energy stored in a capacitor is conducted, on the one hand, to the primary side of a transformer and, on the other hand, to a spark gap via a bypass having a diode.

U.S. Patent Appl. Pub. No. US 2004/000878 A1 describes an ignition system in which an energy store on the secondary side, including multiple capacitors, is charged in order to supply a spark generated with the aid of a transformer with electrical power.

PCT Application No. WO9304279 A1 shows an ignition system including two energy sources. One energy source transfers electrical power via a transformer to a spark gap, while the second energy source is situated between a terminal on the secondary side of the transformer and the electrical ground.

German Patent Application No. DE102013218227A1 describes an ignition system, in which a high-voltage generator generates an ignition spark, which is subsequently supplied with electrical power and maintained by a boost converter.

Ignition systems for internal combustion engines are based on a high-voltage generator, for example, a step-up transformer, with the aid of which power originating from the vehicle battery or from a generator is converted into high voltages, with the aid of which a spark gap is supplied in order to ignite a combustible mixture in the internal combustion engine. For this purpose, a current flowing through the step-up transformer is abruptly interrupted, whereupon the energy stored in the magnetic field of the step-up transformer discharges in the form of a spark.

According to the present invention, the method may be improved with respect to multiple parameters by a suitable influence of the interaction between the primary voltage generator and the boost converter. However, there are still no proposals known in the related art for the corresponding control. It is therefore an object of the present invention to satisfy the above identified need.

SUMMARY

In accordance with the present invention, a method for controlling an ignition system for a spark-ignited internal combustion engine is provided. The ignition system includes a primary voltage generator for generating an ignition spark and a boost converter for maintaining the ignition spark. In a first step, a signal is transmitted from an engine control unit to the ignition system in order to determine a predetermined ignition timing for triggering an ignition spark. This ignition spark is a primary ignition spark, for example, or a single ignition spark for igniting the ignitable mixture present in the combustion chamber. In addition, an additional signal is transmitted from the engine control unit to the ignition system, in order to determine a predetermined additional ignition timing for triggering an additional ignition spark. The additional ignition spark may have a function identical to the previously mentioned ignition spark, but may be generated at a later power stroke (for example, a 720° crankshaft angle later). According to the present invention, a control signal for influencing the operating mode of the boost converter is transmitted from the engine control unit to the ignition system, after the first signal and before the additional signal is transmitted to the ignition system. To influence the operating mode of the boost converter, it is also possible to transmit additional signals prior to the first signal, which enable the operating mode of the ignition system to be influenced in the instantaneous ignition cycle. The control signal is not (or not solely) configured for defining an ignition timing or for triggering an ignition spark, since the boost converter is used primarily for supplying an already generated ignition spark with electrical power. Different advantages result during operation of an aforementioned ignition system, depending on the design, as a result of the described chronological sequence.

Preferred refinements of the present invention of the present invention are described herein.

The signals and the at least one control signal, which is sent between the signals to the ignition system, may pass via an identical signal (for example, an electrical lead) from the engine control unit to the ignition system. This represents a particularly simple topology, which entails material savings, cost savings and weight advantages. The connection of the engine control unit to the ignition system or the transmission of information between the two units may also take place in a simple manner (for example, according to the related art).

The control signal may essentially have a high level identical to the respective signal for determining the ignition timing. Alternatively or in addition, the control signal may have a reduced electrical level compared to the signals for determining the ignition timing, for example, a so-called "low level", which may be understood as a pause between two high-level signals. This simplifies the electrical evaluation of the signals and enhances the interference resistance to interspersed electromagnetic signals.

The operating mode of the boost converter may be influenced, for example, by a point in time and/or by a time duration of the presence of the at least one control signal. Depending on at which point in time the control signal (measured, for example, above the crankshaft angle and/or measured relative to the signals for defining the ignition timing) is transmitted to the ignition system, a switch-on instant of the boost converter, a power output of the boost converter or the like may be defined. Alternatively or in addition, a time duration of a high level or of a low level may also influence the operating mode of the boost converter. Depending on which of the aspects of the operating mode of the boost converter is influenced by the aforementioned parameters of the control signal, the evaluation of the control signal may be greatly simplified or the change of the operating parameter of the boost converter may result directly from the point in time/time duration of the control signal. A comprehensive evaluation of the control signal may be advantageously omitted.

The operating mode of the boost converter may, for example, result via a (chronological) position of an edge (for example, a rising edge of a high level and/or a falling edge of a high level). Both edges of a shared level of the control signal may also be used to influence the operating mode of the boost converter. Such an evaluation is circuitry-wise particularly simple and possible without interferences.

Alternatively or in addition, the operating mode of the boost converter may also be influenced by an evaluation of a number of pulses, which are transmitted as part of the control signal to the ignition system. For example, rising edges and/or falling edges of pulses may be counted and the operating mode of the boost converter may be changed in a predefined manner in response to the ascertained number. For example, the number of pulses may decide about a power level to be output and/or about a time delay of a start of operation of the boost converter relative to the switch-on instant of the primary voltage generator. This type of information transmission is also circuitry-wise easily evaluatable and implementable unsusceptible to interference.

Alternatively or in addition, the operating mode of the boost converter may be influenced as a function of the extent of a high level of the at least one control signal. An energy-related variable (current, voltage, power), in particular, of the boost converter may be adjusted via the extent of the high level. An exact calibration of an output variable of the boost converter may be made, in particular, when using continuously variable levels.

The operating mode of the boost converter may be influenced by the control signal, for example, in the form of a time delay between a switching-on of the primary voltage generator and a switching-on of the boost converter. Alternatively or in addition, a power output of the boost converter may be adapted as a parameter of the operating mode. The power may be adapted, for example, by adapting a pulse duty factor and/or switching frequency of the boost converter. A switch-off instant and/or a start of operation of the boost converter may also be adapted as a parameter of the operating mode. The start of operation of the boost converter in this case may be delayed, for example, for the purpose of suppressing a switch-on spark by the primary voltage generator. In this case, an output voltage directed opposite the output voltage of the primary voltage generator is generated with the aid of the boost converter before or at least concurrently with the switching-on of the primary voltage generator. The aforementioned voltages are therefore oppositely superposed at the spark gap, as a result of which an ignition spark undesirable at this point in time is suppressed.

Multiple control signals may, of course, also be transmitted between the first signal and the additional signal, in order to induce the ignition system to influence additional parameters of the operating mode of the boost converter. Each of the aforementioned parameters may be adapted individually and/or in combination with additional parameters via individual edges and/or levels and/or numbers and/or time durations of control signals. This results in far-reaching possibilities for increasing the efficiency of an internal combustion engine equipped with the ignition system and for lowering its fuel consumption. In other words, each additional control signal may define one or multiple of the aforementioned parameters of the boost converter or of the ignition system.

According to a second aspect of the present invention, an ignition system for a spark-ignited internal combustion engine is described, which includes a primary voltage generator (for example, a conventional ignition transformer) for generating an ignition spark. To maintain the ignition spark, a boost converter is provided, which is electrically looped on the output side with the spark gap of a spark plug. An evaluation unit and a signal input are also provided in the ignition system, the evaluation unit being configured to evaluate signals received via the signal input. Thus, the evaluation unit is configured to receive and evaluate a signal from an engine control unit for determining a predetermined ignition timing for triggering an ignition spark. The evaluation unit is also configured to receive and evaluate a signal from an engine control unit for determining an additional predetermined ignition timing for triggering an additional ignition spark. According to the present invention, the evaluation unit is further configured to receive and evaluate, between the aforementioned signals for determining an ignition timing, a control signal from the engine control unit for influencing the operating mode of the boost converter. After the completed evaluation, the evaluation unit may adapt the operating parameters of the boost converter according to a method, as was described in detail above in connection with the former aspect of the present invention. The features, feature combinations and the advantages resulting therefrom result accordingly.

According to a third aspect of the present invention, an engine control unit is described for controlling an ignition system for a spark-ignited internal combustion engine. The ignition system includes a primary voltage generator for generating an ignition spark and a boost converter for maintaining the ignition spark. Thus, the ignition system controlled by the engine control unit according to the present invention is designed, for example, according to the second-mentioned aspect of the present invention. The engine control unit is configured according to the present invention to transmit via a signal output a signal to the ignition system for determining a predetermined ignition timing for triggering an ignition spark in a first power stroke and to transmit an additional signal via the signal output to the ignition system for determining an additional predetermined ignition timing for triggering an additional ignition spark. The additional ignition timing may, for example, be generated at a later 720° crankshaft angle operating point. According to the present invention, the engine control unit is further configured to transmit via the same signal output a control signal to the ignition system for influencing the operating mode of the boost converter between the signal and the additional signal. In this way, the engine control unit may directly influence the processes within the ignition system designed according to the present invention. The features, feature combinations and the advantages resulting therefrom clearly correspond to those cited in conjunction with the aforementioned aspects of the present invention in such a way that, to avoid repetitions, reference is made to the preceding explanations.

According to a fourth aspect of the present invention, a system or arrangement is described, which includes an ignition system according to the second-mentioned aspect and an engine control unit according to the third-mentioned aspect of the present invention. The signal output of the engine control unit is IT-relatedly connected to a signal input of the ignition system, so that an internal combustion engine equipped in this manner may be extensively optimized with respect to efficiency, fuel consumption, electrode erosion and to other parameters. In other words, the system according to the present invention is configured to carry out a method according to the first-mentioned aspect of the present invention.

BRIEF DESCRIPTION OF THE DRAWINGS

Exemplary embodiments of the present invention are described in detail below with reference to the figures.

DETAILED DESCRIPTION OF EXAMPLE EMBODIMENTS

Figure 1:
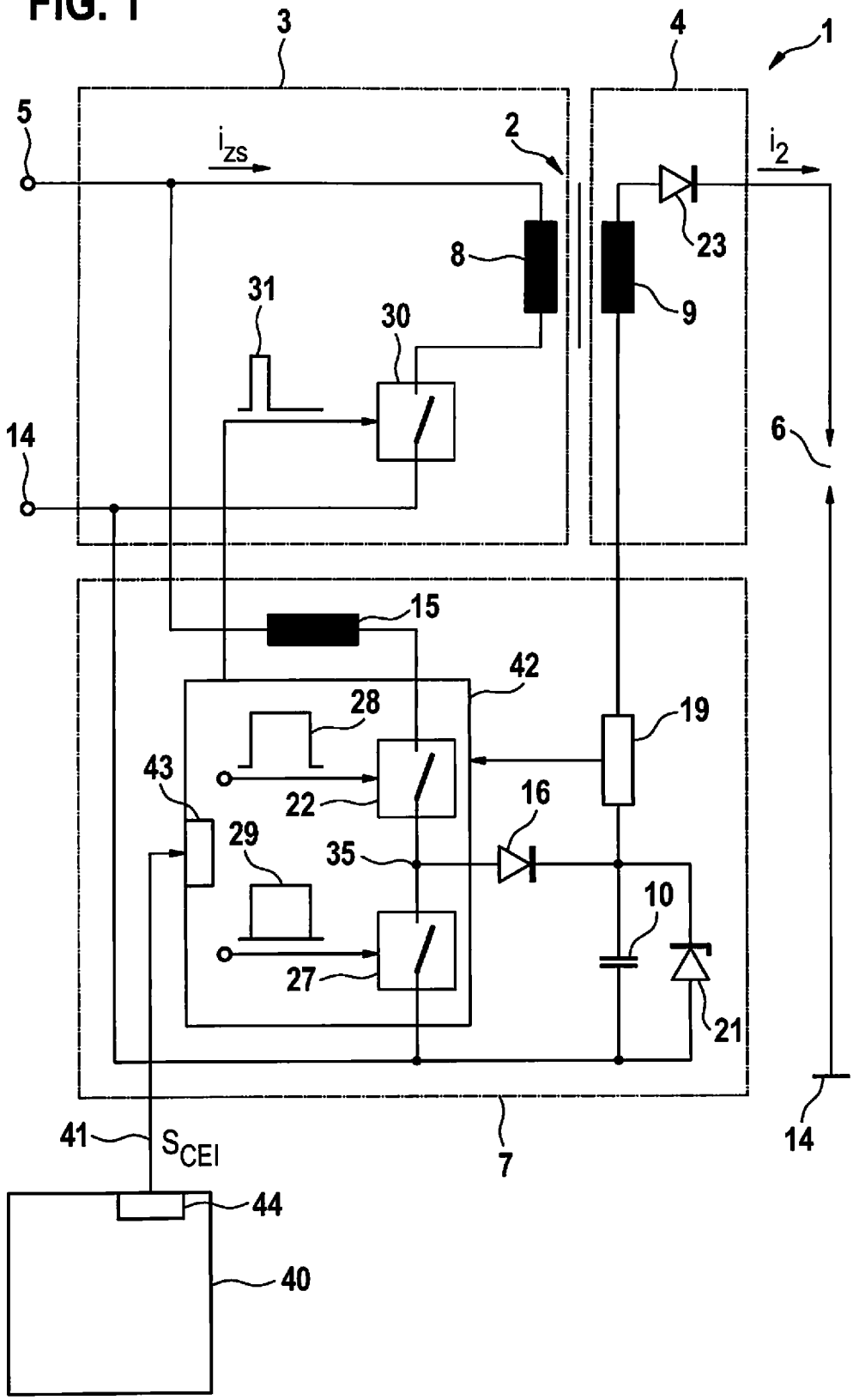
FIG. 1 shows a circuit diagram according to a first exemplary embodiment of an ignition system according to the present invention.

FIG. 1 shows a circuit of an ignition system 1, which includes a step-up transformer 2 as a high voltage generator, the primary side 3 of which may be supplied with electrical power from an electrical energy source 5 via a first switch 30. Secondary side 4 of step-up transformer 2 is supplied with electrical power via an inductive coupling of primary coil 8 and secondary coil 9, and includes a conventional diode 23 for suppressing a switch-on spark, this diode 23 being alternatively replaceable by diode 21. A spark gap 6 is provided in a loop with secondary coil 9 and diode 23 to ground 14, via which the ignition current $i_2$ is intended to ignite the combustible gas mixture. According to the present invention, a boost converter 7 is provided between electrical energy source 5 and secondary side 4 of step-up transformer 2. For this purpose, an inductance 15 is connected via a switch 22 and a diode 16 to a capacitance 10, the one end of which is connected to secondary coil 9 and the other end of which is connected to electrical ground 14. The inductance in this case serves as an energy store in order to maintain a current flow. Diode 16 is conductively oriented in the direction of capacitance 10. A shunt 19 is provided as a current measuring means or voltage measuring means between capacitance 10 and secondary coil 9, the measuring signal of which is fed to switch 22 and to switch 27. In this way, switches 22, 27 are configured to respond to a defined range of current intensity $i_2$ through secondary coil 9. Switches 22 and 27 are connected to each other at node 35. The terminal of switch 22 facing diode 16 is connectable via an additional switch 27 to electrical ground 14. To protect capacitance 10, a Zener diode 21 is connected in the reverse direction in parallel to capacitance 10. In addition, switch signals 28, 29 are indicated, with the aid of which switches 22, 27 may be controlled. Whereas switch signal 28 represents a switching-on and "remaining closed" for an entire ignition cycle, switch signal 29 outlines a concurrent alternating signal between "closed" and "open". With switch 22 closed, inductance 15 is supplied with a current via electrical energy source 5, which flows directly to electrical ground 14 when switches 22, 27 are closed. With switch 27 opened, the current is conducted to capacitor 10 via diode 16. The voltage arising in response to the current in capacitor 10 is added to the voltage dropping over secondary coil 9 of step-up transformer 2, as a result of which the arc at spark gap 6 is supported. Capacitor 10 discharges in the process, however, so that by closing switch 27, power may be brought into the magnetic field of inductance 15 in order to charge capacitor 10 again with this power when switch 27 is opened again. Control 31 of switch 30 provided in primary side 3 is recognizably kept significantly shorter than is the case for switches 22 and 27, Switch 2Z since it assumes no crucial function for the processes according to the present invention, hut rather merely switches the circuit on and off, is merely optional and may therefore be omitted. An engine control unit 40 including a signal output 44 is also depicted, via which signals identified by $S_{CEI}$ for determining a predetermined ignition timing for triggering an ignition spark, and control signals for influencing according to the present invention the operating mode of boost converter 7, are transmitted to an evaluation unit 42 equipped with a signal input 43. In this way, engine control unit 40 may influence extensively the switch states of primary voltage generator 2 and of boost converter 7.

Figure 2:
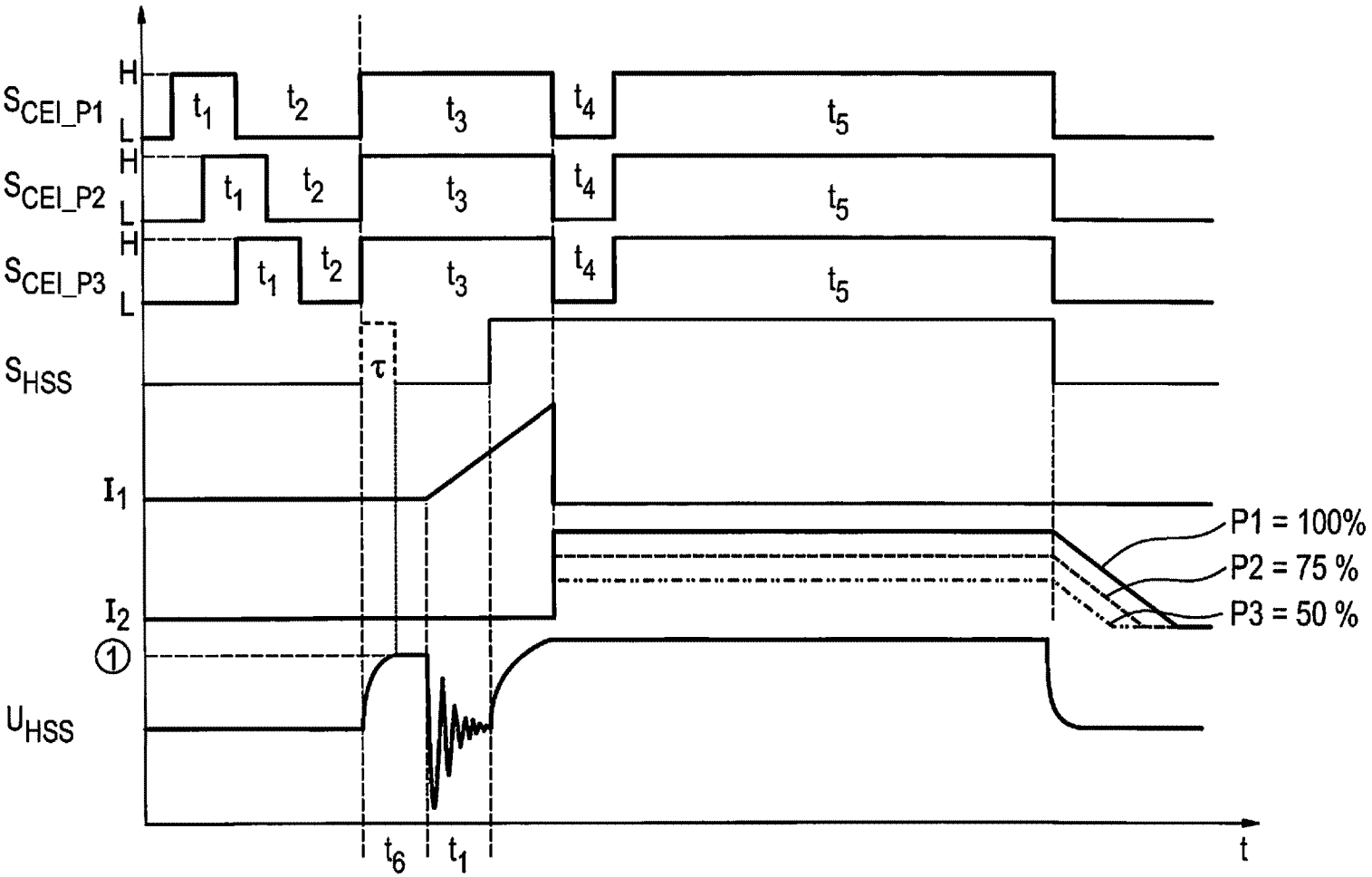
FIG. 2 shows a time diagram of signals and control signals during the operation of an exemplary embodiment of a system according to the present invention when carrying out an exemplary embodiment of a method according to the present invention.

FIG. 2 shows time characteristics of a signal $S_{CEI}$ transmitted from an engine control unit to an ignition system according to the present invention for three different desired power outputs of the boost converter (P1, P2, P3). Depicted among these is switch-on signal $S_{HSS}$ of the boost converter, which results from the time characteristics depicted above it. The time characteristic of a current $I_1$ through the primary side of the ignition coil of the high voltage generator, spark current $I_2$ and an output voltage $U_{HSS}$ of the boost converter are also plotted over time. In the example, a delay time is defined by the duration of control signal $t_1$, which elapses between the switching-on of an ignition transformer current (current $I_1$ through the primary side of the primary voltage generator) and the switching-on of the boost converter. Since the voltage of the boost converter on the output side only gradually approaches a stationary voltage level, it is possible in this way, for example, to control the level of the power supply at the spark gap in the ignition timing. The power level of the boost converter on the output side is recognizably controlled by the duration of control signal $t_2$ exhibiting a low level, in response to which spark current $I_2$ assumes three different time characteristics after the ignition timing. In this case, idealized combustion chamber conditions and an initially constant spark combustion voltage are assumed. The duration of the energization of the ignition transformer is established via time duration $t_3$, reduced by time duration $t_6$. In other words, the closing time ("ignition timing") of the ignition transformer is established. The position of the falling edge of control signal $t_3$, in particular, thus defines the position of the ignition timing over the crankshaft angle. The low level of control signal $t_4$ may be used to control different parameters of the ignition system or of the boost converter. For example, a type of power output variation method for the boost converter may be predefined via the duration of control signal $t_4$. For example, a switch frequency and/or a pulse duty factor of the boost converter may be selected or adapted as a function of the duration. Finally, the switch-off instant of the boost converter is determined via switch signal $t_5$ and, in particular, its falling edge $t_5$. After this point in time, spark current $I_2$ recognizably drops off quickly until the ignition spark breaks off. The rising edge between control signals $t_2$ and $t_3$ recognizably optionally also defines the starting point of a switch operation of the boost converter for a duration $\tau$, via which a voltage overshoot of the ignition system on the output side is avoided, by operating the boost converter for a duration $\tau$ until a predefined voltage threshold value $U_{HSSmax}$ is reached. Voltage $U_{HSS}$ of the boost converter drops drastically the moment current $I_1$ on the primary side is switched on. The voltage at the spark gap, however, remains in a range in which an undesirable ignition is unable to take place. In the example, the power levels of the boost converter are selected at 50%, 75% and 100%. One possibility of reducing undesirable interferences due to an electromagnetic excitation of the surroundings of the ignition system according to the present invention is to adapt the frequency range of the boost converter via signal $t_4$. With a suitable selection or dimensioning of control signals $t_1$ through $t_6$, it is also possible to implement a single-spark operation (without the operation of the boost converter) by controlling a mixture ignition under combustion chamber conditions, which necessitate a low power requirement for generating an ignition spark.

Control signals $t_1$ and/or $t_2$ may, for example, be used for a corresponding control. If a single-spark operation is used for the targeted discharging of a residual voltage remaining at the spark gap, a control signal may be used in order to generate a conductive spark gap for discharging the spark gap in the absence of an ignitable mixture in the combustion chamber. This may take place, for example, by selecting a control signal $t_1$ within a range of predefined limits, upon receipt of which the ignition system recognizes that control signal $t_1$ lies outside the predefined interval. In response to such an input value, the ignition system generates a discharge spark at a point in time in which no ignitable mixture is present in the combustion chamber, as a result of which a residual energy remaining in the ignition system is dissipated without causing damage to the internal combustion engine. A single-spark operation or a quenched spark, for example, may also be generated by control signals $t_2$, which are not predefined for power levels of the boost converter. In other words, a value of $t_2$ invalid for the power position is taken by the ignition system as a signal for starting the single-spark operation or for generating a quenched spark. The ignition system is operated, in principle, in accordance with a conventional inductive ignition coil. This means, the ignition coil is supplied once with power via the energization of the primary side, and the power is used to build up a high voltage and after ignition, the stored magnetic energy remaining in the inductance of the voltage generator is delivered to the spark gap.

Figure 3:
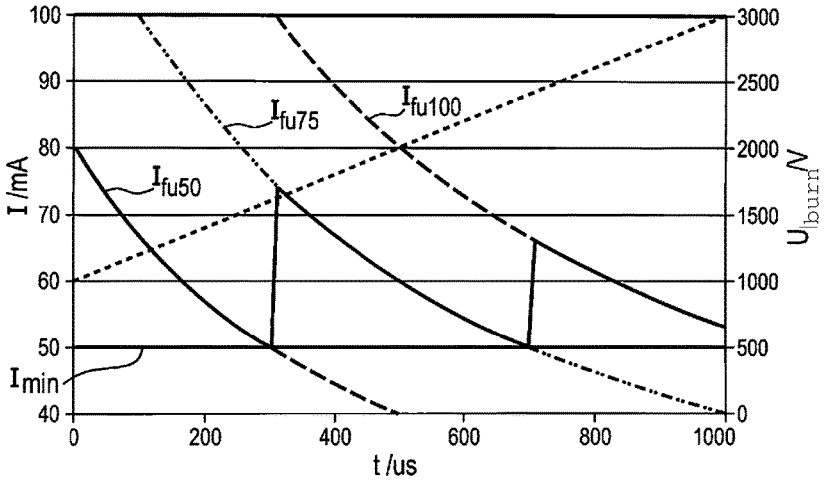
FIG. 3 shows an illustration of an influence of an increased burn voltage on the required power level of an ignition system designed according to the present invention.

FIG. 3 illustrates the required power levels of the boost converter as a function of a spark burning voltage $U_{burn}$. The spark burning voltage $U_{burn}$ is plotted rising essentially linearly over time. At a power level of the boost converter of 50%, the spark current $I_{fu50}$ drops sharply until it reaches a minimum value $I_{min}$. In response thereto, a control signal according to the present invention causes the power level of the boost converter to increase to 75%, as a result of which the resulting spark current $I_{fu75}$ jumps into a stable range. A further increase of the spark burning voltage $U_{burn}$ again results in a reduction of the current to the minimum value of the current $I_{min}$, in response to which a control signal according to the present invention to the ignition system sets the power level of the boost converter to 100%, in response to which the spark current $I_{fu100}$ again jumps to a stable value.

Figure 4:
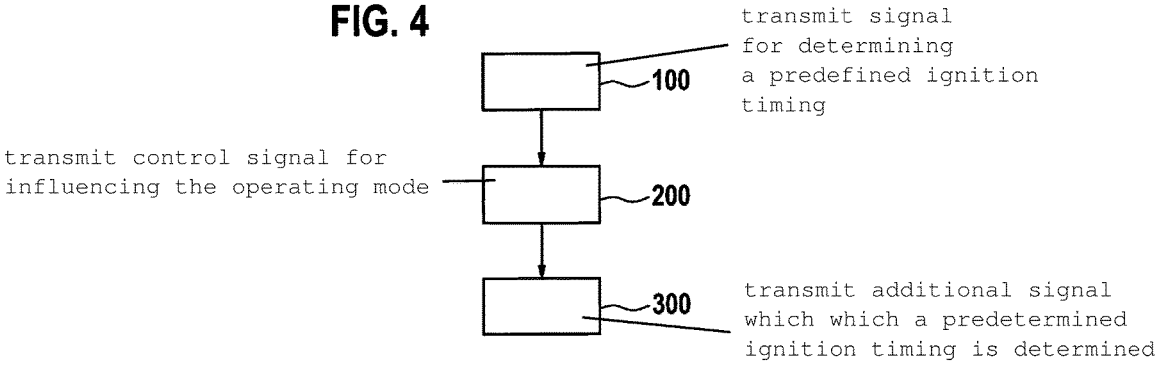
FIG. 4 shows a flow chart illustrating steps of one exemplary embodiment of a method according to the present invention.

FIG. 4 shows steps of an exemplary embodiment of a method according to the present invention for controlling an ignition system for a spark-ignited internal combustion engine having a primary voltage generator for generating an ignition spark and a boost converter for maintaining the ignition spark. In step 100, the method starts by transmitting a signal from an engine control unit to the ignition system, the signal determining a predetermined ignition timing for triggering a first ignition spark. In step 200, a control signal for influencing the operating mode of the boost converter is transmitted from the engine control unit to the ignition system. For example, a piece of information for overlapping the operating mode of the primary voltage generator and the boost converter, a power level to be used and a switch-on spark-suppression function may be communicated. Numerous additional possibilities for the operating parameters to be influenced according to the present invention have been cited above. In step 300, an additional signal is transmitted from the engine control unit to the ignition system, with which a predetermined additional ignition timing for triggering an ignition spark is determined. In this way, the operation of an ignition system including a primary voltage generator and a high voltage generator may be easily controlled and the ignition system itself may be simply designed.

Even though the aspects according to the present invention and advantageous specific embodiments have been described in detail with reference to the exemplary embodiments explained in conjunction with the figures, modifications and combinations of features of the depicted exemplary embodiments are possible for those skilled in the art, without departing from the scope of the present invention.

What is claimed is:

1. A method for controlling an ignition system for a spark-ignited internal combustion engine, having a primary voltage generator for generating an ignition spark and a boost converter for maintaining the ignition spark, the method comprising:

transmitting a signal from an engine control unit to the ignition system to determine a predetermined ignition timing for triggering an ignition spark;

transmitting an additional signal from the engine control unit to the ignition system to determine a predetermined additional ignition timing for triggering an additional ignition spark; and sending a control signal for influencing an operating mode of the boost converter from the engine control unit to the ignition system between the signal and the additional signal, wherein:

each of the signal and the additional signal includes respective sequences of multiple pulses, one specific pulse of the sequence of the signal determines the predetermined ignition timing for triggering the ignition spark, one specific pulse of the sequence of the additional signal determines the predetermined additional ignition timing for triggering the additional ignition spark and between the pulse of the signal and the pulse of the additional signal, the control signal for influencing the operating mode of the boost converter is transmitted in the form of pulses of the signal and in the form of pulses of the additional signal.

2. The method as recited in claim 1, wherein the signal and the control signal are transmitted over an identical channel, the signal and the control signal being sent over an identical electric line.

3. The method as recited in claim 1, wherein the control signal exhibits at least one of: i) a high level identical to that of the signal, and ii) a low level compared to the signal.

4. The method as recited in claim 1, wherein the operating mode of the boost converter is influenced at least one of :i) by a point in time, and ii) by a time duration, of the presence of at least one of a high level and a low level of the control signal.

5. The method as recited in claim 1, wherein the operating mode of the boost converter is influenced by a position of both edges of the control signal.

6. The method as recited in claim 1, wherein the operating mode of the boost converter is influenced by a number of pulses within the control signal.

7. The method as recited in claim 1, wherein the operating mode of the boost converter is influenced by an extent of a high level of the control signal.

8. The method as recited in claim 1, wherein an at least one control signal characterizes at least one of: i) a time delay between a switching-on of the primary voltage generator and a switching-on of the boost converter, ii) a power output of the boost converter, iii) a pulse duty factor of the boost converter, iv) a switching frequency of the boost converter, v) a switch-off instant of the boost converter, and vi) a start of operation of the boost converter for suppressing a switch-on spark by the primary voltage generator.

9. The method as recited in claim 1, wherein additional control signals are sent for influencing additional parameters of the operating mode of the boost converter.

10. The method as recited in claim 9, wherein the additional control signals include at least one of: i) a signal which defines a delay time between a switching-on of the primary voltage generator, in particular, of an ignition transformer current, and a switching-on of the boost converter , ii) a signal which defines a power output of the boost converter, iii) a signal which selects a method for varying the power output of the boost converter, in particular, the use of at least one of a pulse duty factor and a frequency, and iv) a signal which defines a switch-off instant of the boost converter.

11. An ignition system for a spark-ignited internal combustion engine, comprising:

a primary voltage generator for generating an ignition spark;

a boost converter for maintaining the ignition spark;

an evaluation unit; and a signal input, wherein:

the evaluation unit is configured to receive, via the signal input, a signal from an engine control unit for determining a predetermined ignition timing for triggering an ignition spark, and an additional signal from an engine control unit for determining an additional predetermined ignition timing for triggering an additional ignition spark, and wherein the evaluation unit is further configured to receive and to evaluate a control signal from the engine control unit for influencing the operating mode of the boost converter between the signals, each of the signal and the additional signal includes respective sequences of multiple pulses, one specific pulse of the sequence of the signal determines the predetermined ignition timing for triggering the ignition spark, one specific pulse of the sequence of the additional signal determines the additional predetermined ignition timing for triggering the additional ignition spark and between the pulse of the signal and the pulse of the additional signal, the control signal for influencing the operating mode of the boost converter is transmitted in the form of pulses of the signal and in the form of pulses of the additional signal.

12. An engine control unit for controlling an ignition system for a spark-ignited internal combustion engine, having a primary voltage generator for generating an ignition spark and a boost converter for maintaining the ignition spark, which is configured to send via a signal output, a signal to the ignition system for determining a predetermined ignition timing for triggering an ignition spark, and to send an additional signal to the ignition system for determining an additional predetermined ignition timing for triggering an additional ignition spark, wherein the engine control unit is further configured to send via the signal output a control signal to the ignition system for influencing the operating mode of the boost converter between the signal and the additional signal, wherein each of the signal and the additional signal includes respective sequences of multiple pulses, wherein one specific pulse of the sequence of the signal determines the predetermined ignition timing for triggering the ignition spark, wherein one specific pulse of the sequence of the additional signal determines the additional predetermined ignition timing for triggering the additional ignition spark and wherein, between the pulse of the signal and the pulse of the additional signal, the control signal for influencing the operating mode of the boost converter is transmitted in the form of pulses of the signal and in the form of pulses of the additional signal.

13. A system, including an engine control unit for controlling an ignition system for a spark-ignited internal combustion engine, having a primary voltage generator for generating an ignition spark and a boost converter for maintaining the ignition spark, which is configured to send via a signal output, a signal to the ignition system for determining a predetermined ignition timing for triggering an ignition spark, and to send an additional signal to the ignition system for determining an additional predetermined ignition timing for triggering an additional ignition spark, wherein the engine control unit is further configured to send via the signal output a control signal to the ignition system for influencing the operating mode of the boost converter between the signal and the additional signal, a signal output of the engine control unit being connected to a signal input of the ignition system, wherein each of the signal and the additional signal includes respective sequences of multiple pulses, wherein one specific pulse of the sequence of the signal determines the predetermined ignition timing for triggering the ignition spark, wherein one specific pulse of the sequence of the additional signal determines the additional predetermined ignition timing for triggering the additional ignition spark and wherein, between the pulse of the signal and the pulse of the additional signal, the control signal for influencing the operating mode of the boost converter is transmitted in the form of pulses of the signal and in the form of pulses of the additional signal.

* * * * *